US008009123B2

(12) United States Patent
Ishida et al.

(10) Patent No.: US 8,009,123 B2
(45) Date of Patent: Aug. 30, 2011

(54) METHOD FOR GRAYSCALE DISPLAY PROCESSING FOR MULTI-GRAYSCALE DISPLAY TO REDUCE FALSE CONTOURS IN A PLASMA DISPLAY DEVICE

(75) Inventors: Katsuhiro Ishida, Yokohama (JP); Akira Yamamoto, Tokyo (JP); Ayahito Kojima, Kawasaki (JP); Shingo Kubo, Kawasaki (JP); Takashi Shiizaki, Yokohama (JP); Hirohito Kuriyama, Yokohama (JP)

(73) Assignee: Fujitsu Hitachi Plasma Display Limited, Miyazaki-ken (JP)

( * ) Notice: Subject to any disclaimer, the term of this patent is extended or adjusted under 35 U.S.C. 154(b) by 793 days.

(21) Appl. No.: 11/626,874

(22) Filed: Jan. 25, 2007

(65) Prior Publication Data

US 2008/0048942 A1 Feb. 28, 2008

(30) Foreign Application Priority Data

Aug. 23, 2006 (JP) ..... 2006-226632

(51) Int. Cl.
*G09G 3/28* (2006.01)

(52) U.S. Cl. ..... 345/63

(58) Field of Classification Search ..... 345/60–68
See application file for complete search history.

(56) References Cited

U.S. PATENT DOCUMENTS

| | | | | |
|---|---|---|---|---|
| 7,456,808 | B1 * | 11/2008 | Wedding et al. | 345/63 |
| 2004/0070590 | A1 * | 4/2004 | Lee et al. | 345/690 |
| 2006/0170619 | A1 * | 8/2006 | Terai et al. | 345/63 |
| 2006/0267871 | A1 * | 11/2006 | Seong et al. | 345/63 |

FOREIGN PATENT DOCUMENTS

| | | |
|---|---|---|
| JP | 10-031455 | 2/1998 |
| JP | 11-212517 | 8/1999 |
| JP | 11-231827 | 8/1999 |
| JP | 2000-276100 | 10/2000 |
| JP | 2002-278511 | 9/2002 |
| JP | 2003-066891 | 3/2003 |
| JP | 2004-126457 | 4/2004 |
| JP | 2004-133260 | 4/2004 |

* cited by examiner

*Primary Examiner* — Chanh Nguyen
*Assistant Examiner* — Sanghyuk Park
(74) *Attorney, Agent, or Firm* — Antonelli, Terry, Stout & Kraus, LLP

(57) ABSTRACT

In the PDP device, for example, two types of SF lighting patterns (A and B modes) are equally divided and arranged in spatially different regions in a field. For example, the patterns are arranged in a zigzag manner in units of pixels. At all lighting steps, existence of an absence of light-on SF which becomes a cause of false contour is permitted only in one mode. Accordingly, a generation rate of absence of light-on SF per field when the modes are combined is low, and the level of false contour can be reduced. Further, the spatial arrangement of each mode is optionally changed among the fields.

4 Claims, 11 Drawing Sheets

| | A mode | | | | | B mode | | | | | C mode | | | | | D mode | | | | | |
|---|---|---|---|---|---|---|---|---|---|---|---|---|---|---|---|---|---|---|---|---|---|
| step | SF1 | SF2 | SF3 | SF4 | SF5 | SF1 | SF2 | SF3 | SF4 | SF5 | SF1 | SF2 | SF3 | SF4 | SF5 | SF1 | SF2 | SF3 | SF4 | SF5 | R |
| 0 | | | | | | | | | | | | | | | | | | | | | 0% |
| 1 | ○ | | | | | ○ | | | | | ○ | | | | | ○ | | | | | 0% |
| 2 | ▨ | ○ | | | | ○ | | | | | ○ | | | | | ○ | | | | | 25% |
| 3 | ○ | ○ | | | | ○ | | | | | ○ | | | | | ○ | | | | | 0% |
| 4 | ○ | ○ | | | | ○ | | | | | ▨ | ○ | | | | ○ | | | | | 25% |
| 5 | ○ | ○ | | | | ○ | | | | | ○ | ○ | | | | ○ | | | | | 0% |
| 6 | ○ | ○ | | | | ▨ | ○ | | | | ○ | ○ | | | | ○ | | | | | 25% |
| 7 | ○ | ○ | | | | ○ | ○ | | | | ○ | ○ | | | | ○ | | | | | 0% |
| 8 | ○ | ○ | | | | ○ | ○ | | | | ○ | ○ | | | | ▨ | ○ | | | | 25% |
| 9 | ○ | ○ | | | | ○ | ○ | | | | ○ | ○ | | | | ○ | ○ | | | | 0% |
| 10 | ○ | ▨ | ○ | | | ○ | ○ | | | | ○ | ○ | | | | ○ | ○ | | | | 25% |
| 11 | ○ | ○ | ○ | | | ○ | ○ | | | | ○ | ○ | | | | ○ | ○ | | | | 0% |
| 12 | ○ | ○ | ○ | | | ○ | ○ | | | | ○ | ▨ | ○ | | | ○ | ○ | | | | 25% |
| 13 | ○ | ○ | ○ | | | ○ | ○ | | | | ○ | ○ | ○ | | | ○ | ○ | | | | 0% |
| 14 | ○ | ○ | ○ | | | ○ | ▨ | ○ | | | ○ | ○ | ○ | | | ○ | ○ | | | | 25% |
| 15 | ○ | ○ | ○ | | | ○ | ○ | ○ | | | ○ | ○ | ○ | | | ○ | ○ | | | | 0% |
| 16 | ○ | ○ | ○ | | | ○ | ○ | ○ | | | ○ | ○ | ○ | | | ○ | ▨ | ○ | | | 25% |
| 17 | ○ | ○ | ○ | | | ○ | ○ | ○ | | | ○ | ○ | ○ | | | ○ | ○ | ○ | | | 0% |
| 18 | ○ | ○ | ▨ | ○ | | ○ | ○ | ○ | | | ○ | ○ | ○ | | | ○ | ○ | ○ | | | 25% |
| 19 | ○ | ○ | ○ | ○ | | ○ | ○ | ○ | | | ○ | ○ | ○ | | | ○ | ○ | ○ | | | 0% |
| 20 | ○ | ○ | ○ | ○ | | ○ | ○ | ○ | | | ○ | ○ | ▨ | ○ | | ○ | ○ | ○ | | | 25% |
| 21 | ○ | ○ | ○ | ○ | | ○ | ○ | ○ | | | ○ | ○ | ○ | ○ | | ○ | ○ | ○ | | | 0% |
| 22 | ○ | ○ | ○ | ○ | | ○ | ○ | ▨ | ○ | | ○ | ○ | ○ | ○ | | ○ | ○ | ○ | | | 25% |
| 23 | ○ | ○ | ○ | ○ | | ○ | ○ | ○ | ○ | | ○ | ○ | ○ | ○ | | ○ | ○ | ○ | ○ | | 0% |
| 24 | ○ | ○ | ○ | ○ | | ○ | ○ | ○ | ○ | | ○ | ○ | ○ | ○ | | ○ | ○ | ▨ | ○ | | 25% |
| 25 | ○ | ○ | ○ | ○ | | ○ | ○ | ○ | ○ | | ○ | ○ | ○ | ○ | | ○ | ○ | ○ | ○ | | 0% |
| 26 | ○ | ○ | ○ | ▨ | ○ | ○ | ○ | ○ | ○ | | ○ | ○ | ○ | ○ | | ○ | ○ | ○ | ○ | | 25% |
| 27 | ○ | ○ | ○ | ○ | ○ | ○ | ○ | ○ | ○ | | ○ | ○ | ○ | ○ | | ○ | ○ | ○ | ○ | | 0% |
| 28 | ○ | ○ | ○ | ○ | ○ | ○ | ○ | ○ | ○ | | ○ | ○ | ○ | ▨ | ○ | ○ | ○ | ○ | ○ | | 25% |
| 29 | ○ | ○ | ○ | ○ | ○ | ○ | ○ | ○ | ○ | | ○ | ○ | ○ | ○ | ○ | ○ | ○ | ○ | ○ | | 0% |
| 30 | ○ | ○ | ○ | ○ | ○ | ○ | ○ | ○ | ▨ | ○ | ○ | ○ | ○ | ○ | ○ | ○ | ○ | ○ | ○ | | 25% |
| 31 | ○ | ○ | ○ | ○ | ○ | ○ | ○ | ○ | ○ | ○ | ○ | ○ | ○ | ○ | ○ | ○ | ○ | ○ | ○ | | 0% |
| 32 | ○ | ○ | ○ | ○ | ○ | ○ | ○ | ○ | ○ | ○ | ○ | ○ | ○ | ○ | ○ | ○ | ○ | ○ | ▨ | ○ | 25% |
| 33 | ○ | ○ | ○ | ○ | ○ | ○ | ○ | ○ | ○ | ○ | ○ | ○ | ○ | ○ | ○ | ○ | ○ | ○ | ○ | ○ | 0% |

*FIG. 4*

| | | | |
|---|---|---|---|
| A | B | A | B |
| B | A | B | A |
| A | B | A | B |
| B | A | B | A |

*FIG. 5*

| step | A mode | | | | | | | | | | B mode | | | | | | | | | | R |
|---|---|---|---|---|---|---|---|---|---|---|---|---|---|---|---|---|---|---|---|---|---|
| | SF1 | SF2 | SF3 | SF4 | SF5 | SF6 | SF7 | SF8 | SF9 | SF10 | SF1 | SF2 | SF3 | SF4 | SF5 | SF6 | SF7 | SF8 | SF9 | SF10 | |
| 0 | | | | | | | | | | | | | | | | | | | | | 0% |
| 1 | ○ | | | | | | | | | | ○ | | | | | | | | | | 0% |
| 2 | ○ | ○ | | | | | | | | | ▨ | ○ | | | | | | | | | 50% |
| 3 | ○ | ○ | | | | | | | | | ○ | ○ | | | | | | | | | 0% |
| 4 | ○ | ▨ | ○ | | | | | | | | ○ | ○ | | | | | | | | | 50% |
| 5 | ○ | ○ | ○ | | | | | | | | ○ | ▨ | ○ | | | | | | | | 50% |
| 6 | ○ | ○ | ○ | | | | | | | | ○ | ○ | ○ | | | | | | | | 0% |
| 7 | ○ | ○ | ▨ | ○ | | | | | | | ○ | ○ | ○ | | | | | | | | 50% |
| 8 | ○ | ○ | ○ | ○ | | | | | | | ○ | ○ | ▨ | ○ | | | | | | | 50% |
| 9 | ○ | ○ | ○ | ○ | | | | | | | ○ | ▨ | ○ | ○ | | | | | | | 50% |
| 10 | ○ | ○ | ○ | ○ | | | | | | | ○ | ○ | ○ | ○ | | | | | | | 0% |
| 11 | ○ | ○ | ○ | ▨ | ○ | | | | | | ○ | ○ | ○ | ○ | | | | | | | 50% |
| 12 | ○ | ○ | ○ | ○ | ○ | | | | | | ○ | ○ | ○ | ▨ | ○ | | | | | | 50% |
| 13 | ○ | ○ | ○ | ○ | ○ | | | | | | ○ | ○ | ▨ | ○ | ○ | | | | | | 50% |
| 14 | ○ | ○ | ○ | ○ | ○ | | | | | | ○ | ○ | ○ | ○ | ○ | | | | | | 0% |
| 15 | ○ | ○ | ○ | ○ | ▨ | ○ | | | | | ○ | ○ | ○ | ○ | ○ | | | | | | 50% |
| 16 | ○ | ○ | ○ | ○ | ○ | ○ | | | | | ○ | ○ | ○ | ○ | ▨ | ○ | | | | | 50% |
| 17 | ○ | ○ | ○ | ○ | ○ | ○ | | | | | ○ | ○ | ○ | ▨ | ○ | ○ | | | | | 50% |
| 18 | ○ | ○ | ○ | ○ | ○ | ○ | | | | | ○ | ○ | ○ | ○ | ○ | ○ | | | | | 0% |
| 19 | ○ | ○ | ○ | ○ | ○ | ▨ | ○ | | | | ○ | ○ | ○ | ○ | ○ | ○ | | | | | 50% |
| 20 | ○ | ○ | ○ | ○ | ○ | ○ | ○ | | | | ○ | ○ | ○ | ○ | ○ | ▨ | ○ | | | | 50% |
| 21 | ○ | ○ | ○ | ○ | ○ | ○ | ○ | | | | ○ | ○ | ○ | ○ | ▨ | ○ | ○ | | | | 50% |
| 22 | ○ | ○ | ○ | ○ | ○ | ○ | ○ | | | | ○ | ○ | ○ | ▨ | ○ | ○ | ○ | | | | 50% |
| 23 | ○ | ○ | ○ | ○ | ○ | ○ | ○ | | | | ○ | ○ | ○ | ○ | ○ | ○ | ○ | | | | 0% |
| 24 | ○ | ○ | ○ | ○ | ○ | ○ | ▨ | ○ | | | ○ | ○ | ○ | ○ | ○ | ○ | ○ | | | | 50% |
| 25 | ○ | ○ | ○ | ○ | ○ | ○ | ○ | ○ | | | ○ | ○ | ○ | ○ | ○ | ○ | ▨ | ○ | | | 50% |
| 26 | ○ | ○ | ○ | ○ | ○ | ○ | ○ | ○ | | | ○ | ○ | ○ | ○ | ○ | ▨ | ○ | ○ | | | 50% |
| 27 | ○ | ○ | ○ | ○ | ○ | ○ | ○ | ○ | | | ○ | ○ | ○ | ○ | ▨ | ○ | ○ | ○ | | | 50% |
| 28 | ○ | ○ | ○ | ○ | ○ | ○ | ○ | ○ | | | ○ | ○ | ○ | ○ | ○ | ○ | ○ | ○ | | | 0% |
| 29 | ○ | ○ | ○ | ○ | ○ | ○ | ○ | ▨ | ○ | | ○ | ○ | ○ | ○ | ○ | ○ | ○ | ○ | | | 50% |
| 30 | ○ | ○ | ○ | ○ | ○ | ○ | ○ | ○ | ○ | | ○ | ○ | ○ | ○ | ○ | ○ | ○ | ▨ | ○ | | 50% |
| 31 | ○ | ○ | ○ | ○ | ○ | ○ | ○ | ○ | ○ | | ○ | ○ | ○ | ○ | ○ | ○ | ▨ | ○ | ○ | | 50% |
| 32 | ○ | ○ | ○ | ○ | ○ | ○ | ○ | ○ | ○ | | ○ | ○ | ○ | ○ | ○ | ▨ | ○ | ○ | ○ | | 50% |
| 33 | ○ | ○ | ○ | ○ | ○ | ○ | ○ | ○ | ○ | | ○ | ○ | ○ | ○ | ○ | ○ | ○ | ○ | ○ | | 0% |
| 34 | ○ | ○ | ○ | ○ | ○ | ○ | ○ | ○ | ▨ | ○ | ○ | ○ | ○ | ○ | ○ | ○ | ○ | ○ | ○ | | 50% |
| 35 | ○ | ○ | ○ | ○ | ○ | ○ | ○ | ○ | ○ | ○ | ○ | ○ | ○ | ○ | ○ | ○ | ○ | ○ | ▨ | ○ | 50% |
| 36 | ○ | ○ | ○ | ○ | ○ | ○ | ○ | ○ | ○ | ○ | ○ | ○ | ○ | ○ | ○ | ○ | ○ | ▨ | ○ | ○ | 50% |
| 37 | ○ | ○ | ○ | ○ | ○ | ○ | ○ | ○ | ○ | ○ | ○ | ○ | ○ | ○ | ○ | ○ | ▨ | ○ | ○ | ○ | 50% |
| 38 | ○ | ○ | ○ | ○ | ○ | ○ | ○ | ○ | ○ | ○ | ○ | ○ | ○ | ○ | ○ | ○ | ○ | ○ | ○ | ○ | 0% |

*FIG. 6*

| | | | |
|---|---|---|---|
| A | B | A | B |
| C | D | C | D |
| A | B | A | B |
| C | D | C | D |

*FIG. 7*

| | A mode | | | | | B mode | | | | | C mode | | | | | D mode | | | | | |
|---|---|---|---|---|---|---|---|---|---|---|---|---|---|---|---|---|---|---|---|---|---|
| step | SF1 | SF2 | SF3 | SF4 | SF5 | SF1 | SF2 | SF3 | SF4 | SF5 | SF1 | SF2 | SF3 | SF4 | SF5 | SF1 | SF2 | SF3 | SF4 | SF5 | R |
| 0 | | | | | | | | | | | | | | | | | | | | | 0% |
| 1 | ○ | | | | | ○ | | | | | ○ | | | | | ○ | | | | | 0% |
| 2 | ▨ | ○ | | | | ○ | | | | | ○ | | | | | ○ | | | | | 25% |
| 3 | ○ | ○ | | | | ○ | | | | | ○ | | | | | ○ | | | | | 0% |
| 4 | ○ | ○ | | | | ○ | | | | | ▨ | ○ | | | | ○ | | | | | 25% |
| 5 | ○ | ○ | | | | ○ | | | | | ○ | ○ | | | | ○ | | | | | 0% |
| 6 | ○ | ○ | | | | ▨ | ○ | | | | ○ | ○ | | | | ○ | | | | | 25% |
| 7 | ○ | ○ | | | | ○ | ○ | | | | ○ | ○ | | | | ○ | | | | | 0% |
| 8 | ○ | ○ | | | | ○ | ○ | | | | ○ | ○ | | | | ▨ | ○ | | | | 25% |
| 9 | ○ | ○ | | | | ○ | ○ | | | | ○ | ○ | | | | ○ | ○ | | | | 0% |
| 10 | ○ | ▨ | ○ | | | ○ | ○ | | | | ○ | ○ | | | | ○ | ○ | | | | 25% |
| 11 | ○ | ○ | ○ | | | ○ | ○ | | | | ○ | ○ | | | | ○ | ○ | | | | 0% |
| 12 | ○ | ○ | ○ | | | ○ | ○ | | | | ○ | ▨ | ○ | | | ○ | ○ | | | | 25% |
| 13 | ○ | ○ | ○ | | | ○ | ○ | | | | ○ | ○ | ○ | | | ○ | ○ | | | | 0% |
| 14 | ○ | ○ | ○ | | | ○ | ▨ | ○ | | | ○ | ○ | ○ | | | ○ | ○ | | | | 25% |
| 15 | ○ | ○ | ○ | | | ○ | ○ | ○ | | | ○ | ○ | ○ | | | ○ | ○ | | | | 0% |
| 16 | ○ | ○ | ○ | | | ○ | ○ | ○ | | | ○ | ○ | ○ | | | ○ | ▨ | ○ | | | 25% |
| 17 | ○ | ○ | ○ | | | ○ | ○ | ○ | | | ○ | ○ | ○ | | | ○ | ○ | ○ | | | 0% |
| 18 | ○ | ○ | ▨ | ○ | | ○ | ○ | ○ | | | ○ | ○ | ○ | | | ○ | ○ | ○ | | | 25% |
| 19 | ○ | ○ | ○ | ○ | | ○ | ○ | ○ | | | ○ | ○ | ○ | | | ○ | ○ | ○ | | | 0% |
| 20 | ○ | ○ | ○ | ○ | | ○ | ○ | ○ | | | ○ | ○ | ▨ | ○ | | ○ | ○ | ○ | | | 25% |
| 21 | ○ | ○ | ○ | ○ | | ○ | ○ | ○ | | | ○ | ○ | ○ | ○ | | ○ | ○ | ○ | | | 0% |
| 22 | ○ | ○ | ○ | ○ | | ○ | ○ | ▨ | ○ | | ○ | ○ | ○ | ○ | | ○ | ○ | ○ | | | 25% |
| 23 | ○ | ○ | ○ | ○ | | ○ | ○ | ○ | ○ | | ○ | ○ | ○ | ○ | | ○ | ○ | ○ | ○ | | 0% |
| 24 | ○ | ○ | ○ | ○ | | ○ | ○ | ○ | ○ | | ○ | ○ | ○ | ○ | | ○ | ○ | ▨ | ○ | | 25% |
| 25 | ○ | ○ | ○ | ○ | | ○ | ○ | ○ | ○ | | ○ | ○ | ○ | ○ | | ○ | ○ | ○ | ○ | | 0% |
| 26 | ○ | ○ | ○ | ▨ | ○ | ○ | ○ | ○ | ○ | | ○ | ○ | ○ | ○ | | ○ | ○ | ○ | ○ | | 25% |
| 27 | ○ | ○ | ○ | ○ | ○ | ○ | ○ | ○ | ○ | | ○ | ○ | ○ | ○ | | ○ | ○ | ○ | ○ | | 0% |
| 28 | ○ | ○ | ○ | ○ | ○ | ○ | ○ | ○ | ○ | | ○ | ○ | ○ | ▨ | ○ | ○ | ○ | ○ | ○ | | 25% |
| 29 | ○ | ○ | ○ | ○ | ○ | ○ | ○ | ○ | ○ | | ○ | ○ | ○ | ○ | ○ | ○ | ○ | ○ | ○ | | 0% |
| 30 | ○ | ○ | ○ | ○ | ○ | ○ | ○ | ○ | ▨ | ○ | ○ | ○ | ○ | ○ | ○ | ○ | ○ | ○ | ○ | | 25% |
| 31 | ○ | ○ | ○ | ○ | ○ | ○ | ○ | ○ | ○ | ○ | ○ | ○ | ○ | ○ | ○ | ○ | ○ | ○ | ○ | | 0% |
| 32 | ○ | ○ | ○ | ○ | ○ | ○ | ○ | ○ | ○ | ○ | ○ | ○ | ○ | ○ | ○ | ○ | ○ | ○ | ▨ | ○ | 25% |
| 33 | ○ | ○ | ○ | ○ | ○ | ○ | ○ | ○ | ○ | ○ | ○ | ○ | ○ | ○ | ○ | ○ | ○ | ○ | ○ | ○ | 0% |

*FIG. 8*

| ODD-NUMBER FIELD | | | |
|---|---|---|---|
| A | B | A | B |
| B | A | B | A |
| A | B | A | B |
| B | A | B | A |

| EVEN-NUMBER FIELD | | | |
|---|---|---|---|
| B | A | B | A |
| A | B | A | B |
| B | A | B | A |
| A | B | A | B |

*FIG. 9*

| FIRST FIELD | | | |
|---|---|---|---|
| A | B | A | B |
| C | D | C | D |
| A | B | A | B |
| C | D | C | D |

| SECOND FIELD | | | |
|---|---|---|---|
| B | C | B | C |
| D | A | D | A |
| B | C | B | C |
| D | A | D | A |

| THIRD FIELD | | | |
|---|---|---|---|
| C | D | C | D |
| A | B | A | B |
| C | D | C | D |
| A | B | A | B |

| FOURTH FIELD | | | |
|---|---|---|---|
| D | A | D | A |
| B | C | B | C |
| D | A | D | A |
| B | C | B | C |

*FIG. 10*

| ODD-NUMBER FIELD | | | |
|---|---|---|---|
| A | B | A | B |
| A | B | A | B |
| A | B | A | B |
| A | B | A | B |

| EVEN-NUMBER FIELD | | | |
|---|---|---|---|
| B | A | B | A |
| B | A | B | A |
| B | A | B | A |
| B | A | B | A |

*FIG. 11*

| ODD-NUMBER FIELD | | | |
|---|---|---|---|
| A | A | A | A |
| B | B | B | B |
| A | A | A | A |
| B | B | B | B |

| EVEN-NUMBER FIELD | | | |
|---|---|---|---|
| B | B | B | B |
| A | A | A | A |
| B | B | B | B |
| A | A | A | A |

*FIG. 12*

| ODD-NUMBER FIELD | | | |
|---|---|---|---|
| A | B | A | B |
| A | B | A | B |
| B | A | B | A |
| B | A | B | A |

| EVEN-NUMBER FIELD | | | |
|---|---|---|---|
| B | A | B | A |
| B | A | B | A |
| A | B | A | B |
| A | B | A | B |

*FIG. 13*

| Luminance ratio of each SF | SF1 | SF2 | SF3 |
|---|---|---|---|
| | 1 | 2 | 4 |

| step | A mode | | | B mode | | | Average luminance of 2F | Luminance difference from previous step | Increase rate of luminance from previous step |
|---|---|---|---|---|---|---|---|---|---|
| | SF1 | SF2 | SF3 | SF1 | SF2 | SF3 | | | |
| | 1 | 2 | 4 | 1 | 2 | 4 | | | |
| 0 | | | | | | | 0 | - | - |
| 1 | ○ | | | ○ | | | 1 | 1 | - |
| 2 | ○ | ○ | | ▨ | ○ | | 2.5 | 1.5 | 150% |
| 3 | ○ | ○ | | ○ | ○ | | 3 | 0.5 | 20% |
| 4 | ○ | ▨ | ○ | ○ | ○ | | 4 | 1 | 33% |
| 5 | ○ | ○ | ○ | ○ | ▨ | ○ | 6 | 2 | 50% |
| 6 | ○ | ○ | ○ | ○ | ○ | ○ | 7 | 1 | 17% |

*FIG. 14*

| Luminance ratio of each SF | SF1 | SF2 | SF3 |
|---|---|---|---|
| | 1 | 2 | 4 |

| step | A mode | | | B mode | | | Average luminance of 2F | Luminance difference from previous step | Increase rate of luminance from previous step |
|---|---|---|---|---|---|---|---|---|---|
| | SF1 | SF2 | SF3 | SF1 | SF2 | SF3 | | | |
| | 1 | 2 | 4 | 1 | 2 | 4 | | | |
| 0 | | | | | | | 0 | - | - |
| 1 | ○ | | | ○ | | | 1 | 1 | - |
| 2 | ▨ | ○ | | ▨ | ○ | | 2 | 1 | 100% |
| 3 | ○ | ○ | | ○ | ○ | | 3 | 1 | 50% |
| 4 | ▨ | ▨ | ○ | ▨ | ▨ | ○ | 4 | 1 | 33% |
| 5 | ○ | ▨ | ○ | ○ | ▨ | ○ | 5 | 1 | 25% |
| 6 | ▨ | ○ | ○ | ▨ | ○ | ○ | 6 | 1 | 20% |
| 7 | ○ | ○ | ○ | ○ | ○ | ○ | 7 | 1 | 17% |

*FIG. 15*

| step | A mode | | | | | | | | | | B mode | | | | | | | | | | R |
|---|---|---|---|---|---|---|---|---|---|---|---|---|---|---|---|---|---|---|---|---|---|
| | SF1 | SF2 | SF3 | SF4 | SF5 | SF6 | SF7 | SF8 | SF9 | SF10 | SF1 | SF2 | SF3 | SF4 | SF5 | SF6 | SF7 | SF8 | SF9 | SF10 | |
| 0 | | | | | | | | | | | | | | | | | | | | | 0% |
| 1 | ○ | | | | | | | | | | ○ | | | | | | | | | | 0% |
| 2 | ▨ | ○ | | | | | | | | | ▨ | ○ | | | | | | | | | 100% |
| 3 | ○ | ○ | | | | | | | | | ○ | ○ | | | | | | | | | 0% |
| 4 | ▨ | ▨ | ○ | | | | | | | | ▨ | ▨ | ○ | | | | | | | | 200% |
| 5 | ○ | ▨ | ○ | | | | | | | | ○ | ▨ | ○ | | | | | | | | 100% |
| 6 | ▨ | ○ | ○ | | | | | | | | ▨ | ○ | ○ | | | | | | | | 100% |
| 7 | ○ | ○ | ○ | | | | | | | | ○ | ○ | ○ | | | | | | | | 0% |
| 8 | ○ | ○ | ▨ | ○ | | | | | | | ○ | ○ | ○ | | | | | | | | 50% |
| 9 | ○ | ○ | ○ | ○ | | | | | | | ○ | ○ | ▨ | ○ | | | | | | | 50% |
| 10 | ○ | ○ | ○ | ○ | | | | | | | ○ | ▨ | ○ | ○ | | | | | | | 50% |
| 11 | ○ | ○ | ○ | ○ | | | | | | | ○ | ○ | ○ | ○ | | | | | | | 0% |
| 12 | ○ | ○ | ○ | ▨ | ○ | | | | | | ○ | ○ | ○ | ○ | | | | | | | 50% |
| 13 | ○ | ○ | ○ | ○ | ○ | | | | | | ○ | ○ | ○ | ▨ | ○ | | | | | | 50% |
| 14 | ○ | ○ | ○ | ○ | ○ | | | | | | ○ | ○ | ▨ | ○ | ○ | | | | | | 50% |
| 15 | ○ | ○ | ○ | ○ | ○ | | | | | | ○ | ○ | ○ | ○ | ○ | | | | | | 0% |
| 16 | ○ | ○ | ○ | ○ | ▨ | ○ | | | | | ○ | ○ | ○ | ○ | ○ | | | | | | 50% |
| 17 | ○ | ○ | ○ | ○ | ○ | ○ | | | | | ○ | ○ | ○ | ○ | ▨ | ○ | | | | | 50% |
| 18 | ○ | ○ | ○ | ○ | ○ | ○ | | | | | ○ | ○ | ○ | ▨ | ○ | ○ | | | | | 50% |
| 19 | ○ | ○ | ○ | ○ | ○ | ○ | | | | | ○ | ○ | ○ | ○ | ○ | ○ | | | | | 0% |
| 20 | ○ | ○ | ○ | ○ | ○ | ▨ | ○ | | | | ○ | ○ | ○ | ○ | ○ | ○ | | | | | 50% |
| 21 | ○ | ○ | ○ | ○ | ○ | ○ | ○ | | | | ○ | ○ | ○ | ○ | ○ | ▨ | ○ | | | | 50% |
| 22 | ○ | ○ | ○ | ○ | ○ | ○ | ○ | | | | ○ | ○ | ○ | ○ | ▨ | ○ | ○ | | | | 50% |
| 23 | ○ | ○ | ○ | ○ | ○ | ○ | ○ | | | | ○ | ○ | ○ | ▨ | ○ | ○ | ○ | | | | 50% |
| 24 | ○ | ○ | ○ | ○ | ○ | ○ | ○ | | | | ○ | ○ | ○ | ○ | ○ | ○ | ○ | | | | 0% |
| 25 | ○ | ○ | ○ | ○ | ○ | ○ | ▨ | ○ | | | ○ | ○ | ○ | ○ | ○ | ○ | ○ | | | | 50% |
| 26 | ○ | ○ | ○ | ○ | ○ | ○ | ○ | ○ | | | ○ | ○ | ○ | ○ | ○ | ○ | ▨ | ○ | | | 50% |
| 27 | ○ | ○ | ○ | ○ | ○ | ○ | ○ | ○ | | | ○ | ○ | ○ | ○ | ○ | ▨ | ○ | ○ | | | 50% |
| 28 | ○ | ○ | ○ | ○ | ○ | ○ | ○ | ○ | | | ○ | ○ | ○ | ○ | ▨ | ○ | ○ | ○ | | | 50% |
| 29 | ○ | ○ | ○ | ○ | ○ | ○ | ○ | ○ | | | ○ | ○ | ○ | ○ | ○ | ○ | ○ | ○ | | | 0% |
| 30 | ○ | ○ | ○ | ○ | ○ | ○ | ○ | ▨ | ○ | | ○ | ○ | ○ | ○ | ○ | ○ | ○ | ○ | | | 50% |
| 31 | ○ | ○ | ○ | ○ | ○ | ○ | ○ | ○ | ○ | | ○ | ○ | ○ | ○ | ○ | ○ | ○ | ▨ | ○ | | 50% |
| 32 | ○ | ○ | ○ | ○ | ○ | ○ | ○ | ○ | ○ | | ○ | ○ | ○ | ○ | ○ | ○ | ▨ | ○ | ○ | | 50% |
| 33 | ○ | ○ | ○ | ○ | ○ | ○ | ○ | ○ | ○ | | ○ | ○ | ○ | ○ | ○ | ▨ | ○ | ○ | ○ | | 50% |
| 34 | ○ | ○ | ○ | ○ | ○ | ○ | ○ | ○ | ○ | | ○ | ○ | ○ | ○ | ○ | ○ | ○ | ○ | ○ | | 0% |
| 35 | ○ | ○ | ○ | ○ | ○ | ○ | ○ | ○ | ▨ | ○ | ○ | ○ | ○ | ○ | ○ | ○ | ○ | ○ | ○ | | 50% |
| 36 | ○ | ○ | ○ | ○ | ○ | ○ | ○ | ○ | ○ | ○ | ○ | ○ | ○ | ○ | ○ | ○ | ○ | ○ | ▨ | ○ | 50% |
| 37 | ○ | ○ | ○ | ○ | ○ | ○ | ○ | ○ | ○ | ○ | ○ | ○ | ○ | ○ | ○ | ○ | ○ | ▨ | ○ | ○ | 50% |
| 38 | ○ | ○ | ○ | ○ | ○ | ○ | ○ | ○ | ○ | ○ | ○ | ○ | ○ | ○ | ○ | ○ | ▨ | ○ | ○ | ○ | 50% |
| 39 | ○ | ○ | ○ | ○ | ○ | ○ | ○ | ○ | ○ | ○ | ○ | ○ | ○ | ○ | ○ | ○ | ○ | ○ | ○ | ○ | 0% |

*FIG. 16*

| step | SF1 | SF2 | SF3 | SF4 | SF5 | SF6 | SF7 | SF8 | SF9 | SF10 |
|---|---|---|---|---|---|---|---|---|---|---|
| 0 | | | | | | | | | | |
| 1 | ○ | | | | | | | | | |
| 2 | ○ | ○ | | | | | | | | |
| 3 | ○ | ○ | ○ | | | | | | | |
| 4 | ○ | ○ | ○ | ○ | | | | | | |
| 5 | ○ | ○ | ○ | ○ | ○ | | | | | |
| 6 | ○ | ○ | ○ | ○ | ○ | ○ | | | | |
| 7 | ○ | ○ | ○ | ○ | ○ | ○ | ○ | | | |
| 8 | ○ | ○ | ○ | ○ | ○ | ○ | ○ | ○ | | |
| 9 | ○ | ○ | ○ | ○ | ○ | ○ | ○ | ○ | ○ | |
| 10 | ○ | ○ | ○ | ○ | ○ | ○ | ○ | ○ | ○ | ○ |

*FIG.17*

| step | SF1 | SF2 | SF3 | SF4 | SF5 | SF6 | SF7 | SF8 | SF9 | SF10 | R |
|---|---|---|---|---|---|---|---|---|---|---|---|
| 0 | | | | | | | | | | | 0% |
| 1 | ○ | | | | | | | | | | 0% |
| 2 | ▨ | ○ | | | | | | | | | 100% |
| 3 | ○ | ○ | | | | | | | | | 0% |
| 4 | ○ | ▨ | ○ | | | | | | | | 100% |
| 5 | ○ | ○ | ○ | | | | | | | | 0% |
| 6 | ○ | ○ | ▨ | ○ | | | | | | | 100% |
| 7 | ○ | ○ | ○ | ○ | | | | | | | 0% |
| 8 | ○ | ○ | ○ | ▨ | ○ | | | | | | 100% |
| 9 | ○ | ○ | ○ | ○ | ○ | | | | | | 0% |
| 10 | ○ | ○ | ○ | ○ | ▨ | ○ | | | | | 100% |
| 11 | ○ | ○ | ○ | ○ | ○ | ○ | | | | | 0% |
| 12 | ○ | ○ | ○ | ○ | ○ | ▨ | ○ | | | | 100% |
| 13 | ○ | ○ | ○ | ○ | ○ | ○ | ○ | | | | 0% |
| 14 | ○ | ○ | ○ | ○ | ○ | ○ | ▨ | ○ | | | 100% |
| 15 | ○ | ○ | ○ | ○ | ○ | ○ | ○ | ○ | | | 0% |
| 16 | ○ | ○ | ○ | ○ | ○ | ○ | ○ | ▨ | ○ | | 100% |
| 17 | ○ | ○ | ○ | ○ | ○ | ○ | ○ | ○ | ○ | | 0% |
| 18 | ○ | ○ | ○ | ○ | ○ | ○ | ○ | ○ | ▨ | ○ | 100% |
| 19 | ○ | ○ | ○ | ○ | ○ | ○ | ○ | ○ | ○ | ○ | 0% |

METHOD FOR GRAYSCALE DISPLAY PROCESSING FOR MULTI-GRAYSCALE DISPLAY TO REDUCE FALSE CONTOURS IN A PLASMA DISPLAY DEVICE

CROSS-REFERENCE TO RELATED APPLICATION

The present application claims priority from Japanese Patent Application No. JP 2006-226632 filed on Aug. 23, 2006, the content of which is hereby incorporated by reference into this application.

TECHNICAL FIELD OF THE INVENTION

The present invention relates to a technology for a display device that carries out grayscale display processing for multi-grayscale display. More particularly, it relates to a technology for reducing false contours (pseudo contours) of a moving picture on a plasma display device (PDP device) and others provided with a plasma display panel (PDP).

BACKGROUND OF THE INVENTION

Alternating current (AC) type PDP devices are widely used as a flat display. The PDP device carries out grayscale display processing for grayscale expressions by using an intra-frame time division method (subfield method). In the subfield method, a field (or frame) serving as a unit of a video image display which is displayed on a display panel (PDP) is divided into a plurality of subfields (or sub-frames) to which a weight related to brightness at the time of light-on (luminance of light-emission display) is given. Further, grayscale in a cell or a corresponding pixel in the field is expressed by the combination of a light-on and a light-off (non lighting) of the subfields (selective lighting) in the field. In the grayscale display processing, according to input display data (video signal), the display data (field and subfield data) to be outputted to the display panel (PDP) is generated by conversion in accordance with selective lighting of subfields in each cell of the field. In other words, the selective lighting of subfields indicates a corresponding relation between lighting step (referred to as s) associated with grayscale values to be displayed and a combination of light-on and light-off of each subfield in the field (referred to as subfield lighting pattern or the like). Note that, though the lighting step (s) is associated with a grayscale value, they are different from each other.

At the time of displaying a moving picture on the PDP device, lines in purple red and green are generated on the contour lines in skin color portions of person's cheeks and the like. This phenomenon is called false contour or the like and deteriorates the display quality, and therefore some measures are needed. As a cause of the false contour, an absence of a light-on subfield in the subfield lighting pattern is known. The absence of a light-on subfield mentioned here means that a light-off subfield (off state) exists in the middle of a plurality of light-on subfields (on state) at a lighting step (s). For example, when a subfield lighting pattern has a binary encoded structure, a position of a bit carry and the like also correspond to this presence of a light-off subfield.

As the measures against the false contours, the following first method is known as a method which is thought to be most effective in the conventional technology. In this first method, in the case where one field is constituted of m subfields, as a structure of a subfield lighting pattern, the number of lighting steps (s) is set to m+1, and the number of light-on subfields is increased by one every time when the lighting step (s) is increased by one. By this means, an absence of a light-on subfield which is the cause of the false contour is eliminated. FIG. 16 shows an example of subfield lighting pattern in the first method. The first method is disclosed in Japanese Patent No. 3322809 (Patent document 1) and Japanese Patent No. 3365630 (Patent document 2).

SUMMARY OF THE INVENTION

However, when field display is at 60 Hz, generally the number (m) of subfields is often about ten. In this case, the number of lighting steps (s) is only eleven in the first method, which is significantly insufficient for grayscale expression of the video image. In other words, even when a structure for preventing an absence of light-on subfield in a subfield lighting pattern is simply adopted, a side effect of insufficiency of grayscale expression (the number of lighting steps (s)) occurs, and the display quality is thus deteriorated.

Further, as a commonly used conventional method which can sufficiently secure the grayscale expression, the following second method is known. In this second method, a subfield lighting pattern has a structure where lighting steps (s) at which only one subfield in the middle of a plurality of subfields among subfields from the lowest level to the highest level is in an off state (an absence of a light-on subfield) are provided at some positions among all the lighting steps (s) This case is advantageous for grayscale expression because of the increase in the number of lighting steps (s). However, the position of the lighting step (s) where there is an absence of a light-on subfield becomes a cause of the false contour. An example of the subfield lighting pattern in the second method is shown in FIG. 17.

The present invention has been made in consideration of the above problems, and an object of the present invention is to provide a technology capable of enhancing the display quality by means of the measures against false contours at the time of displaying moving pictures while suppressing the insufficiency of grayscale expression, in the technologies for PDP devices and the like that carry out grayscale display processing. In other words, the object of the present invention is to simultaneously achieve both the reduction in false contour level and the securement of the number of grayscale levels.

The typical ones of the inventions disclosed in this application will be briefly described as follows. In order to achieve the above object, the present invention provides a technology for PDP devices and the like that carry out grayscale display processing, and it performs the moving picture display by the use of the intra-frame time division method (subfield method) and comprises the technological means shown below.

In the method for grayscale display processing and the PDP device of the present invention, grayscale display processing is performed, in which field and subfield data are generated by the conversion according to input display data (video signal) in accordance with a subfield lighting pattern and then outputted. At this time, it is possible to select plural (n) types of subfield lighting patterns (modes) for the cells (regions) at spatially different positions in the field. For example, in a matrix of pixels in the field, different modes are repeatedly arranged for each of the pixels.

Also, as a selective lighting state of subfields in a field, for example, a plurality of subfields from the lowest level (light-on SF with the smallest weight: SFmin) to the highest level (light-on SF with the largest weight: SFmax) according to the display data are in a sequential light-on state (all are in an ON-state) in modes (first mode) other than a certain mode (second mode) of the n types of modes, and an absence of light-on SF (off state) exists only in one subfield in the middle of the plurality of subfields from the lowest level (SFmin) to the highest level (SFmax) in the certain mode (second mode). In other words, in all lighting steps (s), an absence of a light-on subfield is permitted only in at most one second mode among the n types of modes.

In the first mode, a false contour is reduced using the concept of the first method described above. In the second mode, the number of lighting steps (s) is secured using the concept of the second method described above. By the spatial combination of the first and second modes, a level of false contour is reduced while securing the number of grayscale levels.

In the method for grayscale display processing and PDP device of the present invention, for the same input grayscale value, as a spatial arrangement of the application of the n types of subfield lighting patterns (modes) in one field, for example, n modes are equally divided and arranged so that each 1/n thereof is distributed. In each field, the rate of positions (regions) where an absence of light-on subfield exists is reduced, and the generation level of false contour becomes half compared with the case of the second method.

Further, the plurality (n) of modes are arranged so as to change at as short intervals as possible spatially and further temporally. As the spatial arrangement, for example, the modes are arranged in a zigzag manner in units of pixels and blocks. As the temporal arrangement, the spatial arrangements of the plurality (n) of modes in a field are inverted or rotated among the plurality (n) of fields so that uniform brightness is obtained in the plurality (n) of sequential fields. By this means, generation of undesirable patterns (hatch pattern and the like) caused by a difference in brightness between the lighting steps (s) in the plurality (n) of modes is eliminated.

The effects obtained by typical aspects of the present invention disclosed in this application will be briefly described below. According to the present invention, in the technology for PDP device that carries out grayscale display processing, the display quality can be enhanced by means of the measures against false contour at the time of displaying moving pictures, while suppressing the insufficiency of grayscale expression.

BRIEF DESCRIPTIONS OF THE DRAWINGS

FIG. 4 is a diagram showing a structure of spatial distribution of two types (n=2) of subfield lighting patterns (modes) in a field in the PDP device of a first embodiment of the present invention;

FIG. 5 is a diagram showing a structure of the two (n=2) types of the modes in the PDP device of the first embodiment of the present invention;

FIG. 6 is a diagram showing a structure of spatial distribution of four types (n=4) of SF lighting patterns (modes) in a field in a PDP device of a second embodiment of the present invention;

FIG. 7 is a diagram showing a structure of the four (n=4) types of the modes in the PDP device of the second embodiment of the present invention;

FIG. 8 is a diagram showing structures of arrangement of two (n=2) types of modes in fields in a PDP device of a third embodiment of the present invention;

FIG. 9 is a diagram showing structures of arrangement of four (n=4) types of modes in fields in a PDP device of a fourth embodiment of the present invention;

FIG. 10 is a diagram showing structural examples (part 1) of arrangement among a plurality of fields in a case of two (n=2) types of modes in a modification example of the PDP device in each embodiment of the present invention;

FIG. 11 is a diagram showing structural examples (part 2) of arrangement among a plurality of fields in a case of two (n=2) types of modes in a modification example of the PDP device in each embodiment of the present invention;

FIG. 12 is a diagram showing structural examples (part 3) of arrangement among a plurality of fields in a case of two (n=2) types of modes in a modification example of the PDP device in each embodiment of the present invention;

FIG. 13 is a diagram showing a relation between lighting steps until all lower three subfields light on and average luminances and others in the case of the structure in FIG. 5;

FIG. 14 is a diagram showing a relation between lighting steps until all lower three subfields light on and average luminances and others in an ordinary binary encoded structure of subfield lighting patterns;

FIG. 15 is a diagram showing a structural example of subfield lighting patterns obtained by combining the structures of FIG. 5 and FIG. 14, in which the presence of light-off SF is permitted in the lower three subfields, in another structural example of the PDP device in each embodiment of the present invention;

FIG. 16 is a diagram showing an example of subfield lighting pattern in a first method of a conventional technology; and FIG. 17 is a diagram showing an example of subfield lighting pattern and the like in a second method of the conventional technology.

DESCRIPTIONS OF THE PREFERRED EMBODIMENTS

Figure 1:
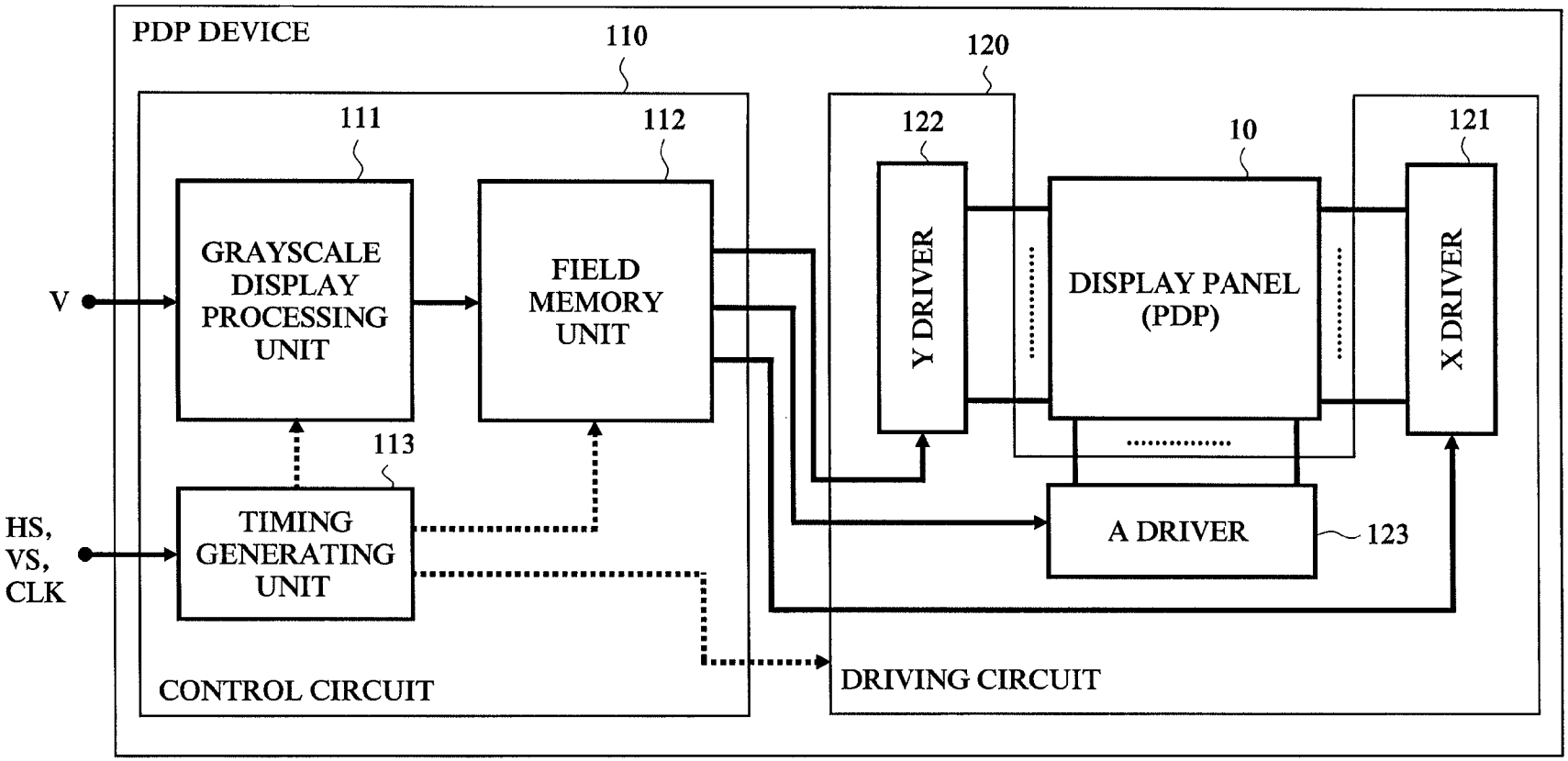
FIG. 1 is a diagram showing the entire structure of a PDP device of an embodiment of the present invention.

Hereinafter, embodiments of the present invention will be described in detail with reference to the accompanying drawings (FIG. 1 to FIG. 17). Note that, in all the drawings to describe the embodiments, the same components are denoted by the same reference numerals in principle, and repetitive descriptions thereof are omitted.

First, with reference to FIG. 16 and FIG. 17, the first and second methods of a conventional technology which is the background technology of the present embodiment will be described in brief. Hereinafter, subfield is abbreviated as SF.

<Conventional Technology: First Method>

FIG. 16 shows an example of a SF lighting pattern table in the first method of the conventional technology. This table shows a corresponding relation between lighting steps (s: step) and combinations of light-on SFs in the field. In this method, one grayscale level is expressed in one SF. Circle marks represent the light-on state (ON state) and blanks other than those represent the light-off state (OFF state). For example, the field consists of ten (m=10) SFs (SF1 to SF10) and eleven lighting steps (s) 0 to 10 are provided. Grayscale values are associated with lighting steps (s), respectively. In this structure, the light-on SFs from the lowest level (SFmin) to the highest level (SFmax) according to the display data are in a sequential light-on state and there is no absence of light-on SF. Therefore, the false contours can be efficiently reduced. However, in this structure, the number of lighting steps (s) is small, that is, the grayscale value capable of being directly expressed is small, and it is significantly insufficient for sufficient grayscale expression. Although well-known error diffusion processing and the like are used to express a grayscale value between grayscale values associated with the lighting steps (s), the grayscale expression is still insufficient in this method.

<Conventional Technology: Second Method>

FIG. 17 shows an example of a SF lighting pattern table in the second method of the conventional technology. In this method, when only one type of the SF lighting pattern is used, lighting steps (s) at which only one SF in the middle of the SFs from the lowest level (SFmin) to the highest level (SFmax) is in an OFF state are provided. The diagonally shaded portions in the blanks particularly represent absences of light-on SFs in the middle of the light-on SFs among light-off SFs. For example, the number of lighting steps (s) is 20 from 0 to 19 for 10 (m=10) SFs (SF1 to SF10) in the field. In this example, when s are odd numbers, the SFs from the lowest level (SFmin) to the highest level (SFmax) are in a sequential light-on state. When s are even numbers except for 0, one absence of light-on SF exists in the middle of the SFs (particularly at the second highest level) up to the highest level. For example, when s is equal to 6 (s=6), SF3 at the second highest level in the middle of SFs from SF1 at the lowest level (SFmin) to SF4 at the highest level (SFmax) is in a light-off state. Further, "SF absence rate per field" represented by R shows a generation rate of absence of light-on SF for each of the fields at a lighting step (s). For example, when s is equal to 6 (s=6), R is considered to be 100% because an absence of light-on SF is generated in SF3.

The second method in FIG. 17 is advantageous for grayscale expression compared with the first method in FIG. 16 because the number of lighting steps (s) increases from 11 to 20. However, a "SF absence rate per field" represented by R that serves as an index of false contour level is 0% or 100%, and its maximum is 100%. Therefore, a position of 100% becomes the cause of the false contour.

First Embodiment

A PDP device according to a first embodiment of the present invention will be described with reference to FIG. 1 to FIG. 5. In the first embodiment, the PDP device has a structure where two types (n=2) of SF lighting patterns are combined and each ½ thereof is equally arranged spatially so that the number of absences of light-on SF becomes half in the regions in the field by way of combination of the first and second methods. By this means, the level of false contour is reduced to half.

<PDP Device>

First, the basic structure will be described. The entire structure of the PDP device in each embodiment will be described with reference to FIG. 1. This PDP device has a structure including a display panel (PDP) 10, a control circuit 110, a driving circuit (driver) 120, and others. The control circuit 110 includes a grayscale display processing unit 111, a field memory unit 112, a timing generating unit 113, and others and it controls the entire PDP device including the driving circuit 120 and others. The driving circuit 120 has an X driver 121, a Y driver 122, an A (address) driver 123, and others and it drives and controls the display panel 10.

The grayscale display processing unit 111 performs grayscale display processing for output of display data by pixel groups of multiple grayscales for the display panel 10 and the driving circuit 120 based on input video signals (V) and outputs the display data (field and SF data). The field memory unit 112 inputs data such as field and SF data from the grayscale display processing unit 111 and temporarily stores it, and it outputs the whole SF data of the field to the driving circuit 120 at the time of display of a next field. The timing generating unit 113 inputs vertical synchronizing signals (VS), horizontal synchronizing signals (HS), clock signals (CLK), and others to generate and output timing signals necessary for controlling the grayscale display processing unit 111, the field memory unit 112, the driving circuit 120, and others.

The driving circuit 120 inputs the field and SF data from the field memory unit 112 and outputs voltage waveforms to drive the display on the display panel 10 to the electrode groups of the display panel 10 in accordance with the field and SF data. In the driving circuit 120, the X driver 121 drives an X electrode group of the display panel 10 by applying a voltage. The Y driver 122 drives a Y electrode group by applying a voltage. The A driver 123 drives an address electrode group by applying a voltage. The display panel 10 is a three-electrode type AC PDP including, for example, X electrodes and Y electrodes for generating sustain discharge for display and address electrodes for address operation. The Y electrodes are also used for scanning operation.

The input video signal (V) is signal/data including information of grayscale values in an RGB format. The field and SF data is the data encoded to the information about ON/OFF of each cell in each SF corresponding to the information of the grayscale values. The control circuit 110 retains data of plural (n) types of SF lighting patterns described later and application settings thereof. The grayscale display processing unit 111 performs conversion processing to field and SF data by using these control data.

<PDP>

Figure 2:
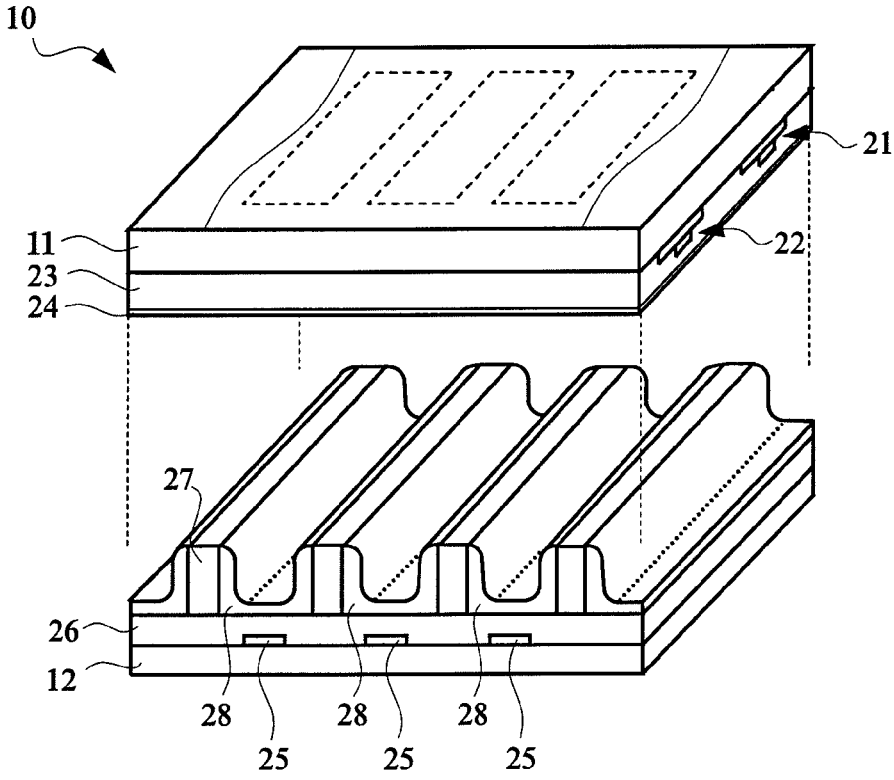
FIG. 2 is a diagram showing a structural example of a display panel (PDP) in the PDP device of the embodiment of the present invention.

An example of a panel structure of the PDP 10 will be described with reference to FIG. 2. FIG. 2 shows a part corresponding to a pixel. In the PDP 10, structures of a front substrate 11 and a rear substrate 12 mainly formed of light emission glass disposed to be opposite to each other are attached to each other, their peripheries are sealed, and discharge gas is filled in the space therebetween.

On the front substrate 11, a plurality of X electrodes 21 and Y electrodes 22 for sustain discharge extending in parallel to a lateral (row) direction are formed so that they are alternately disposed in a vertical (column) direction. These electrodes are covered with a dielectric layer 23 and the surface thereof is further covered with a protective layer 24. On the rear substrate 12, a plurality of address electrodes 25 extending in parallel to each other are disposed in the vertical direction approximately perpendicular to the X electrodes 21 and the Y electrodes 22 and are covered with a dielectric layer 26. On the dielectric layer 26, barrier ribs 27 extending in the vertical direction are formed on both sides of the address electrodes 25 to partition the spaces in the column direction. Further, phosphors 28 which are excited by ultraviolet ray to generate visible light of each color of red (R), green (G), or blue (B) are coated on the upper surface of the dielectric layer 26 on the address electrodes 25 and both side surfaces of the barrier ribs 27.

Rows of display are formed so as to correspond to pairs of the X electrodes 21 and the Y electrodes 22, and columns and cells of the display are formed so as to correspond to the intersections of the address electrodes 25 and the rows. A pixel is formed of a set of R, G, and B cells. Display regions of the PDP 10 are formed by a matrix of the cells (pixels) and are associated with the field and SFs serving as units of video display. PDP has various types of structures according to the driving method and others.

<Field and SF>

Figure 3:
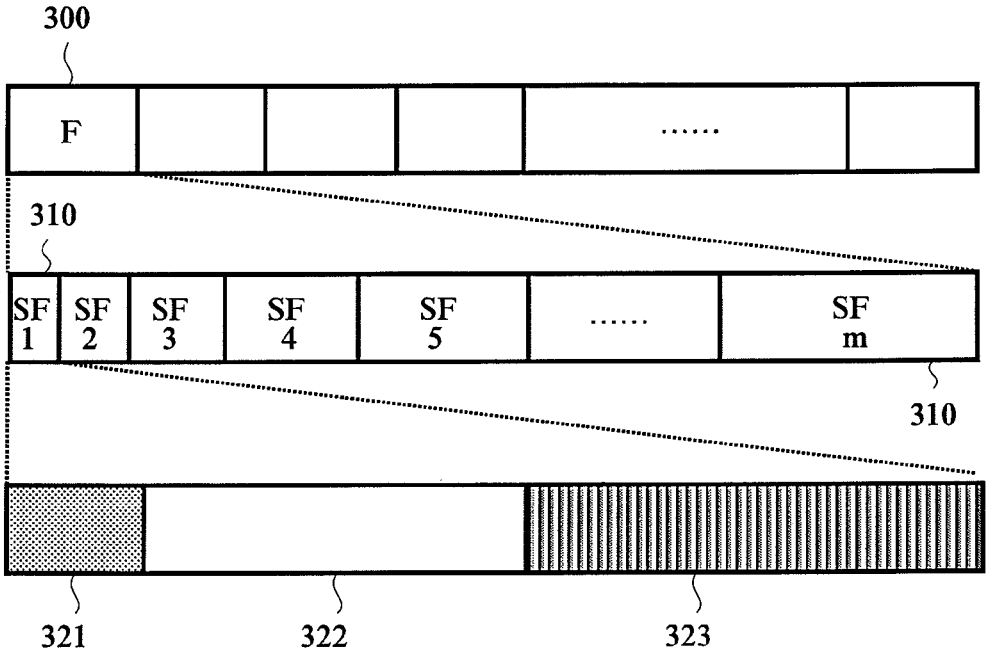
FIG. 3 is a diagram showing a structure of fields and subfields in the PDP device of the embodiment of the present invention.

A driving method of a field (field period) and SF (subfield period) will be described as a basis of driving control of the PDP 10 with reference to FIG. 3. One field (F) 300 is expressed in, for example, 1/60 second. The field (F) 300 comprises a plurality (m) of SFs (SF1 to SFm) 310 temporally divided for the grayscale expression. The SF 310 has a reset period 321, an address period 322, and a sustain period 323. Each of the SFs 310 of the field 300 is weighted by the length of the sustain period 323 (in other words, the number of times of sustain discharge), and grayscale of pixels is expressed by the combination of light-on (ON) and light-off (OFF) of these SFs (SF1 to SFm) 310.

In the reset period 321, all cells of the SF 310 are set to an initial state, and an operation of charge writing and adjustment for a subsequent address period 322 is carried out. In the subsequent address period 322, an address operation to select ON/OFF cells in the cell group in the SF 310 is carried out. That is, by applying scan pulse to the Y electrodes 22 and address pulse to the address electrodes 25 in accordance with display data, address discharge is performed in the cells to be lit (in a case of writing address method). In a following sustain period 323, sustain discharge is carried out to perform an operation of light emission display by applying sustain pulse to the X electrodes and Y electrodes (21 and 22) in the selected cells addressed in the immediately preceding address period 322.

<Mode Arrangement in Field (1)>

Based on the above-described basic structures, the characteristics of the first embodiment will be described. FIG. 4 shows an example of spatial arrangement by way of selective application of a plurality (n) of SF lighting patterns in a field in the first embodiment. In this structure, two (n=2) types of SF lighting patterns can be selected in the regions of cells in the field, and these patterns are mixed and spatially arranged alternately. Hereinafter, SF lighting pattern is referred to as mode. In this example, as a spatial arrangement of these two types of the modes in the field (referred to as A and B modes), the A mode and the B mode are alternately inverted and arranged in a zigzag manner in units of pixels in a matrix of pixels in the field, in other words, in each row and column. Further, the distribution of the respective A and B modes in the field is equally 50%. Also, a pixel is associated with a set of R, G, and B cells. One column of pixels corresponds to three columns of R, G, and B cells.

<Mode Structure (1)>

Next, FIG. 5 shows structures of the two types of SF lighting patterns (A and B modes) in the structure of FIG. 4 in the first embodiment. In the structure consisting of ten (m=10) SFs (SF1 to SF10) in a field, the SFs are arranged in the order of small brightness weight. In this example, the number of lighting steps (s) is 39 from 0 to 38.

The SF lighting pattern (SF conversion table) determines an ON/Off state of each of the SFs (SF1 to SF10) in the field for each lighting step (s) corresponding to the grayscale of the pixels in a field to be displayed. A grayscale value is associated with a lighting step (s), and when a value between the grayscale values is expressed, a well-known error diffusion processing and the like are used.

For example, when paying attention to s=7, the SFs 1, 2, and 4 are in a light-on state in the A mode, and the SFs 1, 2, and 3 are in a light-on state in the B mode. In other words, different SFs are lit at the same lighting step (s) in the A mode and the B mode. In this case, in the structure of the B mode, a false contour is hardly generated because the SFs from the lowest level (SFmin=SF1) to the highest level (SFmax=SF3) according to the display data in the SFs 1, 2, and 3 are in a sequential light-on state and there is no absence of light-on SF in the middle of the SFs 1 to 3. On the other hand, in the SFs 1, 2, 3, and 4 in the A mode, the SF3 (second highest level) in the middle of the SFs from the lowest level (SFmin=SF1) to the highest level (SFmax=SF4)) according to the display data is an absence of light-on SF due to the light-off, and this SF3 becomes a cause of the false contour.

Here, in the structure in FIG. 4, a distribution of the respective A and B modes in a spatial arrangement in one field is equally 50%. Accordingly, the mode to be a cause of false contour in one field is only the A mode, and it spatially occupies only 50%. Therefore, an effect to reduce the level of false contour to half can be obtained compared with a case where only a single SF lighting pattern having an absence of light-on SF is used.

When paying attention to FIG. 5 again, in all the lighting steps (s) from 0 to 38, all the SFs from the lowest level (SFmin) to the highest level (SFmax) are in a sequential light-on state (the number of absences of light-on SF is zero) in either one of the A mode and the B mode. Meanwhile, in the other mode, only one SF in the middle of the SFs from the lowest level (SFmin) to the highest level (SFmax) is in a light-off state (the number of absences of light-on SF is one). Accordingly, R: "SF absence rate per field", that is, a rate of existence of absence of one light-on SF in the middle of the SFs from the lowest level (SFmin) to the highest level (SFmax) per field in the combined A and B modes is 0% or 50%, and the rate is at most 50%.

Also, in this example, the A mode has eight lighting steps (s) at which absences of light-on SF exist, whereas the B mode has twenty lighting steps (s) at which absences of light-on SF exist. In other words, the number of absences of light-on SF is designed to be smaller in the structure of the A mode. Further, in a plurality of lighting steps (s) such as s=6, all SFs are in a sequential light-on state from the lowest level (SFmin) to the highest level (SFmax) in both of the A mode and the B mode.

As described above, since the structures in FIG. 4 and FIG. 5 that use the spatial arrangements of the two types of the modes in the field are employed in the first embodiment, the number of lighting steps (s), i.e. grayscale expression can be secured compared with that in the conventional first method, and the level of false contour is reduced to half compared with that in the conventional second method.

Second Embodiment

Next, a second embodiment will be described with reference to FIG. 6, FIG. 7 and others. The basic structure in the second embodiment is similar to that in the first embodiment, and four (n=4) types of SF lighting patterns (A, B, C, and D modes) can be selected in the regions of a field.

<Mode Arrangement in Field (2)>

FIG. 6 shows the spatial arrangement of these A to D modes in a field, in which the A to D modes are equally distributed so that different modes are repeated between adjacent pixels in units of blocks of two rows and two columns.

<Mode Structure (2)>

FIG. 7 shows structures of the four types of the SF lighting patterns (the A to D modes) in the structure in FIG. 6. Further, in FIG. 7, if all lighting steps (s) are illustrated, the number thereof becomes too large, and therefore, only a portion of 34 lighting steps (s) that correspond to the lower five SFs (SF1 to SF5) is illustrated. Note that the remaining portion of the SFs (SF6 to SF10) has the similar structure.

For example, when paying attention to s=18, the SFs 1, 2, and 4 are in a light-on state in the A mode, and the SFs 1, 2, and 3 are in a light-on state in the B, C, and D modes. Only in the A mode, the SF3 in the middle of the SFs from SF1 to SF4 is in a light-off state and an absence of light-on SF exists, which becomes a cause of false contour. The SF1 to SF3 are in a sequential light-on state in the B, C, and D modes.

Here, as shown in FIG. 6, the respective A to D modes have an equal spatial distribution of 25% in the field. Accordingly, the mode to be a cause of false contour in one field is only the A mode, and it spatially occupies only 25%. Therefore, the level of false contour is further reduced to half in this structure using four (n=4) types of modes compared with the structure using two (n=2) types of modes described above.

When focusing attention on FIG. 7 again, in all the lighting steps (s) from 0 to 33, all the SFs from the lowest level (SFmin) to the highest level (SFmax) are in a sequential light-on state in the three modes of the A to D modes. Meanwhile, in the other one mode, only one SF in the middle of the SFs from the lowest level (SFmin) to the highest level (SFmax) is in a light-off state. Accordingly, R: "SF absence rate per field" is 0% or 25%, and the rate is at most 25%. Further, the absence of light-on SF occurs in any one of the A, B, C, and D modes. Furthermore, at a plurality of lighting steps (s) such as s=17, any modes do not have the absence of light-on SF.

As described above, since the structures in FIG. 6 and FIG. 7 that use the spatial arrangements of the four types of the modes in the field are employed in the second embodiment, the number of lighting steps (s), i.e. grayscale expression can be secured compared with that in the conventional first method, and the level of false contour is reduced to ¼ compared with that in the conventional second method.

Third Embodiment

Next, a third embodiment will be described with reference to FIG. 8 and others. The basic structure in the third embodiment is similar to that in the first embodiment. Further, in the structure of the third embodiment, spatial mode arrangements in fields of the two (n=2) types of the SF lighting patterns described above are inverted between the two (odd number and even number) fields.

<Mode Arrangement Between Fields (1)>

When paying attention to the step s=7 in the structure of spatial arrangement of the two (n=2) types of the A and B modes in FIG. 4 and FIG. 5 again, the SFs 1, 2, and 4 are in a light-on state in the A mode, and the SFs 1, 2, and 3 are in a light-on state in the B mode. In this case, it is assumed that the luminance ratios (weight) of the SF1 to SF4 are 1, 2, 4, and 8, respectively. Then, the total brightness of the light-on SFs in the A mode is 1+2+8=11, and that of the light-on SFs in the B mode is 1+2+4=7. Accordingly, the cells with brightness of 11 and 7 appear in a zigzag manner in a video image at this lighting step (s=7) in accordance with the arrangement in FIG. 4 although a single grayscale expression is performed. As a result, the display quality is deteriorated.

For its prevention, the third embodiment employs a structure as shown in FIG. 8, in which the arrangements of the A mode and the B mode in the fields are inverted between the odd-number and even-number fields. By this means, one grayscale can be expressed in the two sequential fields, and the appearance of luminance in the time direction becomes an average brightness of the A and B modes, for example, (11+7)/2=9 in all the cells. Thus, the cells do not appear in a zigzag manner, and the video image can be recognized as an image of uniform grayscale expression. Therefore, it is possible to suppress the deterioration of the display quality.

Fourth Embodiment

Next, a fourth embodiment will be described with reference to FIG. 9 and others. As the fourth embodiment, a structure in which mode arrangements in fields are changed among a plurality of fields similar to the structure of the third embodiment is applied to the structure in the second embodiment shown in FIG. 6.

<Mode Arrangement Among Fields (2)>

As shown in FIG. 9, spatial mode arrangements are changed so that the positions of A to D modes are circulated among four sequential fields of first to fourth fields. By this means, one grayscale can be expressed by the four sequential fields, and as the appearance of luminance in the time direction, the video image can be recognized as an image of uniform grayscale expression. Therefore, it is possible to suppress the deterioration of the display quality.

<Others (1)>

In each of the above-described embodiments, as the measures to suppress false contour, the structure in which the number of absences of light-on SF at the lighting steps (s) is reduced or the absences are distributed basically using a plurality of modes is employed. Alternatively, also when the number of absences of light-on SF at lighting steps in a mode is small, the frequency of generation of false contour is reduced, and the generation of false contour can be suppressed. At least one type of the mode among plural types of the modes should be designed to have a structure in which the number of light-off SFs is reduced as much as possible.

As is apparent from FIG. 5 described above, the number of lighting steps, which include the absence of light-on SF, among the 39 lighting steps (s) by the 10 SFs is eight in the A mode. In other words, the A mode has a structure in which the number of lighting steps including the absence of light-on SF is minimum, that is, m−2=8, with respect to the number (m=10) of SFs forming the field. Thus, the frequency of generation of false contour is reduced, and the generation of false contour can be suppressed.

<Others (2)>

Next, modification examples of each embodiment described above will be described with reference to FIG. 10 to FIG. 12. First, as a method of distributing the modes in a field, a structure in which different modes are arranged in spatially adjacent cell regions as much as possible like the arrangement in a zigzag manner in units of pixels (one row and one column) in FIG. 8 is preferred in terms of picture quality.

Alternatively, for example, the structure in which the A and B modes are inverted per column in the pixel matrix as shown in FIG. 10, the structure in which the A and B modes are inverted per row as shown in FIG. 11, and the structure in which the A and B modes are inverted in a zigzag manner in units of blocks of two rows×one column are possible. Also in these structures, the video image can be recognized as an image of uniform grayscale expression. Therefore, it is possible to suppress the deterioration of the display quality.

<Others (3)>

Next, FIG. 13 to FIG. 15 show other structural examples applicable to each of the embodiments described above. FIG. 13 shows a relation between lighting steps (s=0 to 6) until all of the lower three SFs light on and the average luminance in the field and among the fields, in the case where the luminance ratios of the lower three SFs (SF1 to SF3) in the structure in FIG. 5 (FIG. 4, FIG. 8, etc) are set to 1, 2, and 4, respectively. At the steps s=0 to 6, the total brightnesses of the light-on SFs are {0, 1, 3, 3, 5, 7, and 7} in the A mode, and {0, 1, 2, 3, 3, 5, and 7} in the B mode. Also, the average luminances in two fields (F) of the A and B modes are {0, 1, 2.5, 3, 4, 6, and 7}. Further, the differences in luminance between a grayscale step (s) and the previous grayscale step (s) thereof are {-, 1, 1.5, 0.5, 1, 2, and 1}. Furthermore, the increase rates (%) of luminance between a grayscale step (s) and the previous grayscale step (s) thereof are (-, -, 150, 20, 33, 50, and 17), respectively.

On the other hand, FIG. 14 shows a relation between lighting steps (s=0 to 7) and the respective average luminances with respect to the similar lower three SFs in the case where the SF selective lighting for lighting steps (s) has the binary encoded structure. At steps s=0 to 7, the total brightness of the light-on SFs ranges from 0 to 7 in the A and B modes, and the average luminance of the two fields (F) is also the same in the A and B modes. Further, the differences in luminance between the grayscale steps (s) are all one. Furthermore, the increase rates (%) of luminance between grayscale steps (s) are {-, 150, 20, 33, 50, and 17}, respectively.

As shown in FIG. 14, an average luminance in the two fields (F) (and an average luminance in one field) increases by one every time when a lighting step (s) rises by one. Also, with respect to a luminance increase rate (%) between lighting steps (s), for example, when a position at s=4 is considered, the luminance level is three at the one previous step s=3 and the luminance level at the step s=4 increases by one to four, and therefore, the luminance increase rate (%) is thought to be ⅓=33%.

When the display level (grayscale value) between the steps s=3 and s=4 is complemented by well-known error diffusion processing and then expressed, a case where the solid display thereof is performed, that is, a case where the display by the same input display data value (for example, 3.5) as that between the steps s=3 and s=4 is performed among a plurality of pixels will be considered. In this case, a video image in which the steps s=3 and s=4 are mixed among the pixels appears. In this case, if a difference in luminance level between the steps s=3 and s=4 is large, a pattern (hatch pattern and the like) due to the distribution of the error diffusion is visually recognized. Accordingly, rough video image with less grayscale expression is recognized, and the display quality is deteriorated.

Here, as shown in FIG. 13 illustrated above, the differences in average luminance between lighting steps (s) in the two fields (F) when a lighting step (s) rises by one are 0.5 to 2. A problem arises at the steps s=2 and s=5 where the differences between the step and the previous step (s) thereof are as large as 1.5 and 2, and the luminance increase rates (%) thereof are 150% and 50%, respectively. This is recognized as a rough video image with less grayscale expression compared with that in the structure in FIG. 14, and the display quality is deteriorated.

Thus, for its prevention, this example employs the structure using the SF lighting patterns shown in FIG. 15 in which the structures in FIG. 5 and FIG. 14 are combined. The part of the lighting steps (s=2 to 6) enclosed in the dotted lines of FIG. 15 is the same as that of corresponding part in the binary encoded structure in FIG. 14. In this way, in combination with the structure in the above described embodiment, the structure in which the presence of light-off SFs is permitted in the lower three SFs (SF1 to SF3) is employed (SFs actually in a light off state are lower two SFs).

According to this structural example, increase of luminance level at lighting step (s) that is particularly conspicuous on the lower grayscale side is suppressed, and further, since the luminance on the lower grayscale side is low, generation of false contour is hardly conspicuous in general. Also, since almost the same degree of the effect of reducing the false contour can be obtained, it is possible to suppress the deterioration of the display quality.

As described above, according to each of the embodiments, by the structure obtained by spatial and temporal combination with taking into account the conventional first and second methods, the effect of reducing false contour at the time of displaying the moving picture can be achieved while suppressing the insufficiency of grayscale expression.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention can be applied to a display device which carries out the grayscale display processing such as a PDP device, a liquid crystal display and others.

What is claimed is:

1. A method for grayscale display processing in which, when a moving picture of multiple grayscales is displayed on a display panel, a field corresponding to the moving picture is temporally divided into a plurality of subfields from a lowest level to a highest level each weighted by luminance, and grayscale of pixels in the field is expressed by selective lighting of the plurality of subfields in accordance with input display data, wherein:

the plurality of subfields are arranged in an ascending order of luminance weight from a subfield with a smallest weight to a subfield with a largest weight, four types of patterns are provided as patterns of the selective lighting of the subfields, and in accordance with the input display data, the four types of patterns are disposed so that four pixels adjacent in vertical and horizontal directions have different patterns, when a predetermined grayscale level among all grayscale levels is to be expressed, in one pattern of the four types of patterns, only one subfield out of subfields with smaller weight than that of a subfield whose weight is the largest among the subfields to be lit on is not lit on, and in other three patterns, all subfields with smaller weight than that of the subfield whose weight is the largest among the subfields to be lit on are lit on, and when grayscale levels other than the predetermined grayscale level among all grayscale levels are to be expressed, in all patterns of the four types of patterns, all subfields with smaller weight than that of the subfield whose weight is the largest among the subfields to be lit on are lit on.

2. The method for grayscale display processing according to claim 1, wherein the four types of patterns can be selected for the same spatial regions in respective sequential four fields, and the four types of patterns are optionally selected for each of the same regions in the sequential four fields.

3. A plasma display device comprising:

a plasma display panel on which pixels of cells are formed by electrode groups; and a circuit unit that drives and controls the plasma display panel, in which, when a moving picture of multiple grayscales is displayed on the plasma display panel, a field corresponding to the moving picture is temporally divided into a plurality of subfields from a lowest level to a highest level each weighted by luminance, and grayscale of pixels in the field is expressed by selective lighting of the plurality of subfields in accordance with input display data, wherein:

the plurality of subfields are arranged in an ascending order of luminance weight from a subfield with a smallest weight to a subfield with a largest weight, four types of patterns are provided as patterns of the selective lighting of the subfields, and in accordance with the input display data, the four types of patterns are disposed so that four pixels adjacent in vertical and horizontal directions have different patterns, when a predetermined grayscale level among all grayscale levels is to be expressed, in one pattern of the four types of patterns, only one subfield out of subfields with smaller weight than that of a subfield whose weight is the largest among the subfields to be lit on is not lit on, and in other three patterns, all subfields with smaller weight than that of the subfield whose weight is the largest among the subfields to be lit on are lit on, and when grayscale levels other than the predetermined grayscale level among all grayscale levels are to be expressed, in all patterns of the four types of patterns, all subfields with smaller weight than that of the subfield whose weight is the largest among the subfields to be lit on are lit on.

4. The plasma display device according to claim 3, wherein the four types of patterns can be selected for the same spatial regions in respective sequential four fields, and the four types of patterns are optionally selected for each of the same regions in the sequential four fields.

* * * * *